US010115353B2

(12) United States Patent
Xing et al.

(10) Patent No.: US 10,115,353 B2
(45) Date of Patent: Oct. 30, 2018

(54) BACKLIGHT ADJUSTMENT METHOD, LIQUID CRYSTAL DISPLAY DEVICE AND ELECTRONIC APPARATUS

(71) Applicant: Wuhan China Star Optoelectronics Technology Co., Ltd., Wuhan, Hubei (CN)

(72) Inventors: Zhenzhou Xing, Guangdong (CN); Qingcheng Zuo, Guangdong (CN); Xingling Guo, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 238 days.

(21) Appl. No.: 14/915,236

(22) PCT Filed: Jan. 14, 2016

(86) PCT No.: PCT/CN2016/070910

§ 371 (c)(1),
(2) Date: Feb. 28, 2016

(87) PCT Pub. No.: WO2017/107265

PCT Pub. Date: Jun. 29, 2017

(65) Prior Publication Data

US 2018/0047346 A1 Feb. 15, 2018

(30) Foreign Application Priority Data

Dec. 21, 2015 (CN) ..... 2015 1 0963790

(51) Int. Cl.
*G09G 3/34* (2006.01)
*G09G 3/36* (2006.01)

(52) U.S. Cl.
CPC ..... *G09G 3/3406* (2013.01); *G09G 3/36* (2013.01); *G09G 2320/062* (2013.01);
(Continued)

(58) Field of Classification Search
CPC ..... G09G 3/2014; G09G 2310/06; G09G 3/3406; G09G 3/2081; G09G 2320/064;
(Continued)

(56) References Cited

U.S. PATENT DOCUMENTS

2008/0231585 A1* 9/2008 Wu ..... G09G 3/3406 345/99
2009/0091528 A1* 4/2009 Hong ..... G09G 3/3406 345/102
(Continued)

FOREIGN PATENT DOCUMENTS

CN 101162573 A 4/2008
CN 101271208 A 9/2008
(Continued)

*Primary Examiner* — Sanjiv D Patel
(74) *Attorney, Agent, or Firm* — Andrew C. Cheng

(57) ABSTRACT

The present invention provides a liquid crystal display device, comprising a backlight part, and the liquid crystal display device includes an image collection circuit, a gray scale judgment circuit, a PWM signal generation circuit and a LED driving circuit, and the backlight part is electrically coupled to the LED driving circuit; the image collection circuit obtains a gray scale of a target image and transmits the gray scale of the target image to the gray scale judgment circuit, and the gray scale judgment circuit compares the gray scale of the target image with a preset gray scale threshold to generate a control signal to be transmitted to the PWM signal generation circuit; the PWM signal generation circuit generates a PWM signal of which a duty ratio is zero to be transmitted to the LED driving circuit, and the LED driving circuit cuts off an input current of the backlight part.

12 Claims, 2 Drawing Sheets

(52) U.S. Cl.
CPC ..... *G09G 2320/064* (2013.01); *G09G 2320/0646* (2013.01); *G09G 2330/021* (2013.01); *G09G 2330/023* (2013.01)

(58) Field of Classification Search
CPC .. G02B 6/0046; G02B 6/0076; G02B 6/0078; G02F 1/133603; G02F 2001/133601; G02F 1/133602; G02F 2001/133612; G02F 1/133604; G02F 1/1336; H01L 2924/12044; H03K 7/08; G03B 21/2053
See application file for complete search history.

(56) References Cited

U.S. PATENT DOCUMENTS

2010/0213871 A1* 8/2010 Chen ..... G09G 3/3406 315/295
2011/0084980 A1 4/2011 Lee
2011/0298834 A1* 12/2011 Shin ..... G09G 3/3406 345/690
2012/0182332 A1* 7/2012 Liu ..... G09G 3/2007 345/691
2013/0249958 A1* 9/2013 Matsuura ..... G09G 3/3426 345/690
2015/0054413 A1* 2/2015 Chen ..... H05B 37/0281 315/155
2016/0063688 A1* 3/2016 Yang ..... H04N 5/44504 345/589
2016/0247471 A1* 8/2016 Zhang ..... G09G 3/3648

FOREIGN PATENT DOCUMENTS

CN 101599258 A 12/2009
CN 101770751 A 7/2010
CN 104575406 A 4/2015

* cited by examiner

BACKLIGHT ADJUSTMENT METHOD, LIQUID CRYSTAL DISPLAY DEVICE AND ELECTRONIC APPARATUS

CROSS REFERENCE

This application claims the priority of Chinese Patent Application No. 201510963790.8, entitled "Backlight adjustment method, liquid crystal display device and electronic apparatus", filed on Dec. 21, 2015, the disclosure of which is incorporated herein by reference in its entirety.

FIELD OF THE INVENTION

The present invention relates to a display technology field, and more particularly to a backlight adjustment method, a liquid crystal display device and an electronic apparatus.

BACKGROUND OF THE INVENTION

With the increasingly developed electronic industry, the electronic apparatuses, such as the Mobile Phone, the Personal Digital Assistant (PDA), the Notebook and the Planet Computer are developed toward the direction of being lighter, thinner, portable and multifunction. Nevertheless, as the electronic apparatus gets lighter and thinner, the development of the portability limits the size and capability of the battery of the electronic apparatus. Therefore, under the circumstance that the battery capability is limited, it becomes necessary to reduce the power consumption for increasing the battery life of the electronic apparatus.

Backlight Part

Normally, the element of which the power consumption is the largest in the liquid crystal panel of the electronic apparatus, such as the mobile phone is the backlight part. The backlight parts of the most electronic apparatuses stay in constant bright state as working. In prior art, the brightness of the backlight part is adjusted according to the Content Adaptive Brightness Control (CABC) technology, which is to achieve the objective of saving the power consumption by increasing the content gray scale standard and meanwhile reducing the backlight brightness. However, as the liquid crystal panel of the electronic apparatus shows the dark image, the backlight part remains to be set in the activation state. Such adjustment counts against the backlight power consumption decrease of the apparatus and shortens the battery life of the electronic apparatus. The solution and the improvement are urgently desired.

SUMMARY OF THE INVENTION

An objective of the present invention is to provide a liquid crystal display device capable of reducing the loss of the backlight part and promoting the battery life.

Another objective of the present invention is to provide an electronic apparatus utilizing the aforesaid liquid crystal display device.

Another objective of the present invention is to provide a backlight adjustment method of the aforesaid liquid crystal display device.

For realizing the aforesaid objective, the technical solution provided by the embodiments of the present invention is:

The present invention provides a liquid crystal display device, comprising a backlight part, wherein the liquid crystal display device comprises an image collection circuit, a gray scale judgment circuit, a PWM signal generation circuit and a LED driving circuit, which are electrically coupled in order, and the backlight part is electrically coupled to the LED driving circuit; the image collection circuit obtains a gray scale of a target image and transmits the gray scale of the target image to the gray scale judgment circuit, and the gray scale judgment circuit compares the gray scale of the target image with a preset gray scale threshold to generate a control signal, and transmits the control signal to the PWM signal generation circuit; the PWM signal generation circuit responds with the control signal to generate a PWM signal of which a duty ratio is zero, and transmits the PWM signal to the LED driving circuit, and the LED driving circuit responds with the PWM signal to cut off an input current of the backlight part.

As the gray scale judgment circuit judges that the gray scale of the target image is smaller than the preset gray scale threshold, the gray scale judgment circuit outputs the control signal to the PWM signal generation circuit, and the PWM signal generation circuit adjusts the duty ratio of the PWM signal to be zero after receiving the control signal, and the LED driving circuit cuts off the input current of the backlight part according to the PWM signal; as the gray scale judgment circuit judges that the gray scale of the target image is larger than or equal to the preset gray scale threshold, the backlight part is inputted with a backlight current and is in an activation state.

The preset gray scale threshold is 10.

The PWM signal generation circuit adjusts the duty ratio of the PWM signal in real time according to the input current of the backlight part currently transmitted by the LED driving circuit as the PWM signal is generated.

The PWM signal generation circuit comprises a square wave generator.

The present invention further provides an electronic apparatus, comprising a liquid crystal display device, and the liquid crystal display device comprises a backlight part, wherein the liquid crystal display device comprises an image collection circuit, a gray scale judgment circuit, a PWM signal generation circuit and a LED driving circuit, which are electrically coupled in order, and the backlight part is electrically coupled to the LED driving circuit; the image collection circuit obtains a gray scale of a target image and transmits the gray scale of the target image to the gray scale judgment circuit, and the gray scale judgment circuit compares the gray scale of the target image with a preset gray scale threshold to generate a control signal, and transmits the control signal to the PWM signal generation circuit; the PWM signal generation circuit responds with the control signal to generate a PWM signal of which a duty ratio is zero, and transmits the PWM signal to the LED driving circuit, and the LED driving circuit responds with the PWM signal to cut off an input current of the backlight part.

As the gray scale judgment circuit judges that the gray scale of the target image is smaller than the preset gray scale threshold, the gray scale judgment circuit outputs the control signal to the PWM signal generation circuit, and the PWM signal generation circuit adjusts the duty ratio of the PWM signal to be zero after receiving the control signal, and the LED driving circuit cuts off the input current of the backlight part according to the PWM signal; as the gray scale judgment circuit judges that the gray scale of the target image is larger than or equal to the preset gray scale threshold, the backlight part is inputted with a backlight current and is in an activation state.

The preset gray scale threshold is 10.

The PWM signal generation circuit adjusts the duty ratio of the PWM signal in real time according to the input current of the backlight part currently transmitted by the LED driving circuit as the PWM signal is generated.

The PWM signal generation circuit comprises a square wave generator.

The present invention further provides a backlight adjustment method, wherein the backlight adjustment method comprises:

obtaining a gray scale of a target image with an image collection circuit and transmitting the gray scale of the target image to a gray scale judgment circuit;

comparing the gray scale of the target image with a preset gray scale threshold with a gray scale judgment circuit;

outputting a corresponding control signal to a PWM signal generation circuit with a gray scale judgment circuit as the gray scale of the target image is smaller than a preset gray scale threshold, and the PWM signal generation circuit generates a PWM signal of which a duty ratio is zero, and outputs the PWM signal to a LED driving circuit; and cutting off an input current of a backlight part with the LED driving circuit according to the PWM signal of which the duty ratio is zero.

As the duty ratio of the PWM signal is not zero, the input current transmitted to the backlight part is positively correlated with the duty ratio of the PWM signal, and as the duty ratio of the PWM signal is zero, the input current of the backlight part is not transmitted to the backlight part.

The preset gray scale threshold is 10.

As the gray scale judgment circuit judges that the gray scale of the target image is larger than or equal to the preset gray scale threshold, the PWM signal generation circuit adjusts the duty ratio of the PWM signal in real time according to the input current of the backlight part currently transmitted by the LED driving circuit as the PWM signal is generated, and the LED driving circuit adjusts the input current outputted to the backlight part in real time according to the PWM signal.

The embodiments of the present invention have advantages or benefits:

In the present invention, the image collection circuit obtains the gray scale of the target image, and the gray scale judgment circuit compares the gray scale with the preset gray scale threshold. As the gray scale of the target image is smaller than the preset gray scale threshold, the control signal generated for the PWM signal generation circuit is outputted to the PWM signal generation circuit, and the PWM signal generation circuit adjusts the duty ratio of the PWM signal to be zero, and the LED driving circuit responds the PWM signal and cuts off the current of the backlight part to save the energy consumption of the backlight part, and thus to achieve the technical result of promoting the battery life.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are merely part of embodiments of the present invention, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise, For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

Figure 1:
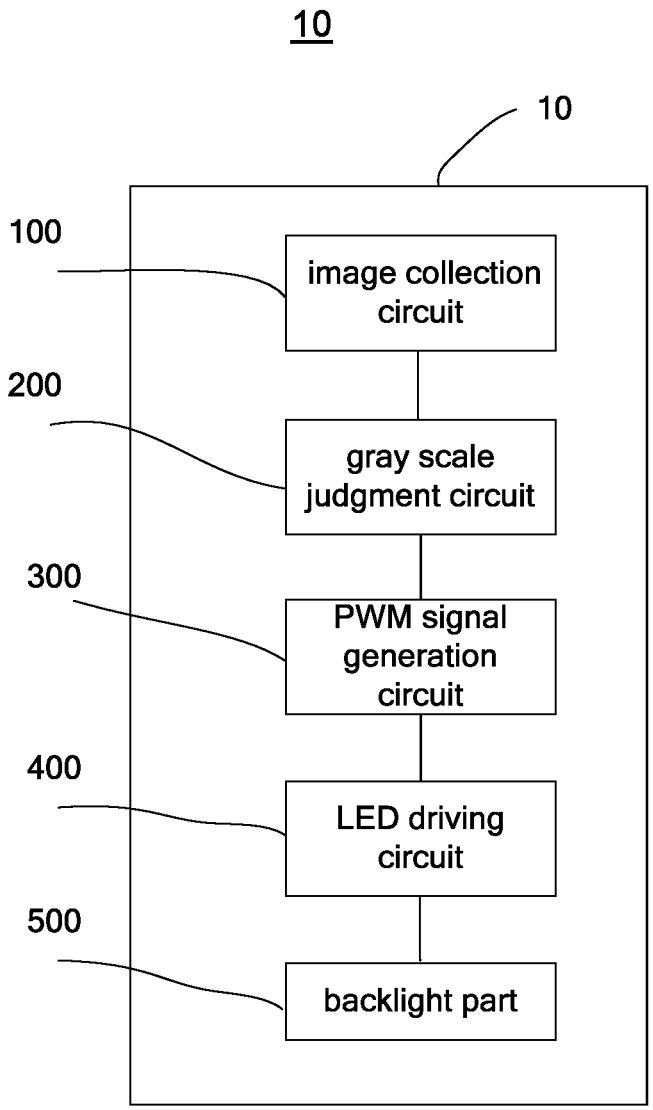
FIG. 1 is a structure diagram of a liquid crystal display device according to the present invention.

Please refer to FIG. 1. FIG. 1 is a structure diagram of a liquid crystal display device according to the present invention. The liquid crystal display 10 provided by the embodiment of the present invention comprises an image collection circuit 100, a gray scale judgment circuit 200, a Pulse Width Modulation (PWM) signal generation circuit 300, a LED driving circuit 400 and a backlight part 500. The image collection circuit 100, the gray scale judgment circuit 200, the PWM signal generation circuit 300, the LED driving circuit 400 and the backlight part 500 are electrically coupled in order.

Specifically, in the embodiment of the present invention, the image collection circuit 100 is employed to obtain a gray scale of a target image. The gray scale is a concept of the brightness. The range of the gray scale is 0-255, and the gray scale is an integer. The scales from small to big represents the brightnesses from dark to shallow, which correspond to the colors in the image from black to white. Each pixel value in the image is one of 256 gray scales between the black and white. The image collection circuit 100 transmits the obtained gray scale of the target image to the gray scale judgment circuit 200. The gray scale judgment circuit 200 compares that with the preset gray scale threshold after receiving the gray scale of the target image, and outputs corresponding control signal to the PWM signal generation circuit 300 according to the comparison result. Specifically, the gray scale threshold can be written into the gray scale judgment circuit 200 before shipment by the maker. Alternatively, the user can preset it in the gray scale judgment circuit 200 according actual demands of production and usage.

The PWM signal generation circuit 300 receives the control signal, and generates the corresponding PWM signal according to the control signal. The PWM signal generation circuit 300 outputs the PWM signal to the LED driving circuit 400. The LED driving circuit 400 controls the current of the backlight part 500 according to the PWM signal. The backlight part 500 can be a backlight module, which can provide sufficient brightness and the uniformly distributed light source so that the liquid crystal display device 10 can normally show images.

Specifically, as the gray scale judgment circuit 200 judges that the gray scale of the target image is smaller than the preset gray scale threshold, i.e. as the liquid crystal display device 10 shows the dark state image, the gray scale judgment circuit 200 outputs the control signal to the PWM signal generation circuit 300. The PWM signal generation circuit 300 adjusts the duty ratio of the PWM signal to be zero after the control signal is received, and thus, the LED driving circuit 400 stops transmitting the backlight current to the backlight part 500 according to the PWM signal, i.e. to shut down the backlight part 500 to achieve that status that the liquid crystal display device 10 shows the dark state image.

By judging the gray scale of the target image shown by the liquid crystal display device in the present invention, as the gray scale of the target image is smaller than the preset gray scale threshold, i.e. as the image shown by the liquid crystal display device is the dark state image, the backlight current flowing into the backlight part is cut off to shut down the backlight part. Namely, the backlight part is in a deactivation state. Accordingly, the energy consumption of the backlight part of the liquid crystal display can be decreased to promote the technical result of the battery life.

Specifically, the preset gray scale threshold can be set to be 10. When the gray scale of the target image shown by the liquid crystal display 10 is smaller than 10, basically, the image of the liquid crystal display 10 is the dark state image. The backlight part 500 can be shut down to show the dark state image. Thus, the power consumption of the backlight part 500 of the liquid crystal display can be saved.

Furthermore, as the gray scale judgment circuit 200 judges that the gray scale of the target image is larger than or equal to the preset gray scale threshold, i.e. the image shown by the liquid crystal display device 10 is not the dark state image, the backlight part 500 is inputted with the backlight current and is in an activation state. Normally, as showing the images of different gray scales, the currents of the backlight part 500 are different. Therefore, for changing the gray scale of the image, the current inputted to the backlight part 500 needs to be adjusted in real time. That is to say, as the liquid crystal display device 10 does not show the dark state image, the backlight current of the backlight part 500 can be adjusted so that the generated gray scale of the current image and the gray scale of the target image can be the same. In this process, as the PWM signal generation circuit 300 generates the PWM signal, the duty ratio of the PWM signal can be adjusted in real time according to the backlight current currently outputted to the backlight part 500 by the LED driving circuit 400 until the backlight current currently outputted to the backlight part 500 by the LED driving circuit 400 reaches the predetermined value of the backlight current. In other words, the PWM signal generation circuit 300 can adjust the duty ratio of the PWM signal in real time until the gray scale of the current image is equal to the gray scale of the target image.

Furthermore in detail, the gray scale judgment circuit 200 and the PWM signal generation circuit 300 can be integrated in the Driver IC. After the image collection circuit 100 transmits the collected gray scale of the target image to the Driver IC, the Driver IC outputs the corresponding PWM signal to the LED driving circuit 400 to control the LED driving circuit according to the internal analysis result, and thus to control the backlight current of the backlight part 500 so that the gray scale of the current image is equal to the gray scale of the target image.

Furthermore in detail, the aforesaid PWM signal generation circuit can be achieved with a square wave generator.

Furthermore in detail, the LED driving circuit 400 can specifically comprise: an input filter, a power switch, an inductor or a transformer, an output rectifier or filter, a dimming controller and a main control circuit. The input end Vin of the LED driving circuit 400 is coupled to power source, and the output end Vout outputs the backlight current and the backlight voltage to the backlight part, and the output end Vout is coupled to the dimming controller, and feeds back the outputted backlight current to the dimming controller so that the dimming controller can adjust the backlight current and the backlight voltage in time.

Furthermore, the backlight part 500 can be a LED light bar.

The present invention also provides an electronic apparatus. The electronic apparatus comprises the liquid crystal display shown in FIG. 1. The electronic apparatus can be the mobile phone, the tablet, the television, the monitor, the notebook, the digital picture frame, the navigator and et cetera but not limited thereto.

Figure 2:
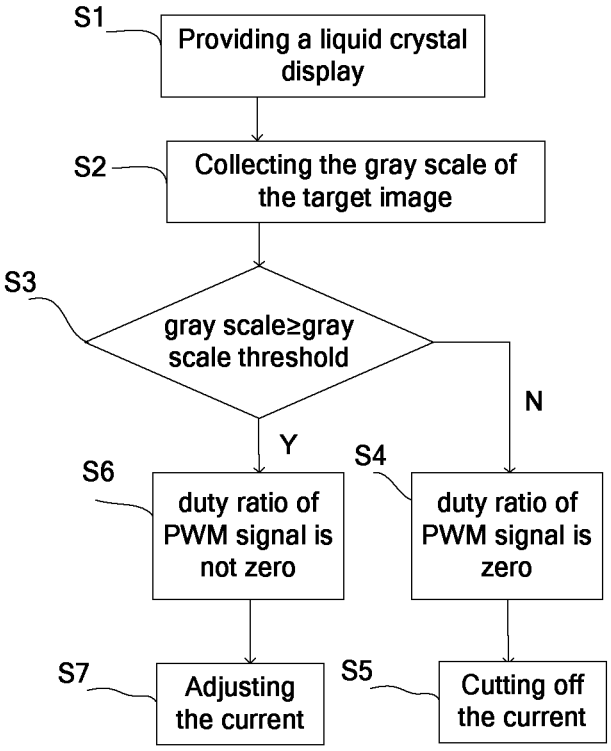
FIG. 2 is a flowchart of a backlight adjustment method according to the present invention.

Please refer to FIG. 2. The present invention further provides a backlight adjustment method, which at least comprises steps of:

step 1, providing a liquid crystal display, wherein the liquid crystal display comprises an image collection circuit, a gray scale judgment circuit, a PWM signal generation circuit, a LED driving circuit and a backlight part;

step S2, obtaining a gray scale of a target image with an image collection circuit and transmitting the gray scale of the target image to a gray scale judgment circuit;

step S3, comparing the gray scale of the target image with a preset gray scale threshold with a gray scale judgment circuit. Specifically, as the gray scale judgment circuit judges that the gray scale of the target image is smaller than the preset gray scale threshold, then step S4 is executed; as the gray scale judgment circuit judges that the gray scale of the target image is larger than or equal to the preset gray scale threshold, then step S6 is executed;

step S4, outputting a corresponding control signal to a PWM signal generation circuit with the gray scale judgment circuit as the gray scale of the target image is smaller than the preset gray scale threshold, and the PWM signal generation circuit adjusts the duty ratio of the PWM signal to be zero after the PWM signal generation circuit receives the control signal, and transmits the PWM signal to the LED driving circuit; namely, the PWM signal generation circuit adjusts the duty ratio of the PWM signal to be zero and transmits the same to the LED driving circuit as the gray scale of the target image is smaller than the preset gray scale threshold;

step S5, cutting off the backlight current transmitted to the backlight part in responding to the PWM signal after the LED driving circuit receives the PWM signal of which the duty ratio is zero, i.e. shutting down the backlight part to make the liquid crystal display show a dark state image.

step S6, as the gray scale judgment circuit judges that the gray scale of the target image is larger than or equal to the preset gray scale threshold, as the PWM signal generation circuit adjusts the duty ratio of the PWM signal in real time according to the input current of the backlight part transmitted by the LED driving circuit as the PWM signal is generated, and the LED driving circuit adjusts the backlight currently outputted to the backlight part in real time according to the PWM signal. Until the current currently outputted to the backlight part reaches the predetermined value of the target current, then the gray scale of the current image will be equal to the gray scale of the target image; namely, the image shown by the liquid crystal display is not the dark state image, and the PWM generation circuit can stop adjusting the duty ratio of the PWM signal in real time until the gray scale of the current image is equal to the gray scale of the target image. Normally, the bigger the gray scale the image is, the larger the loading current required by the backlight part is.

step S7, outputting the backlight current corresponding to the duty ratio of the PWM signal to the backlight part after the LED driving circuit receives the PWM signal of which the duty ratio is not zero. Namely, the LED driving circuit adjusts the backlight current according to the duty ratio of the PWM signal to make the gray scale of the image shown by the liquid crystal display be equal to the gray scale of the target image.

Furthermore, the gray scale of the image is between 0-255. When the gray scale of the target image shown by the liquid crystal display 10 is smaller than 10, basically, the image of the liquid crystal display 10 is the dark state image. That is to say, the preset gray scale threshold can be set to be 10. As the gray scale of the target image shown by the liquid crystal display is smaller than 10, the backlight part 500 can be shut down to show the dark state image. Thus, the power consumption of the backlight part 500 of the liquid crystal display can be saved.

Furthermore, in the process of adjusting the input current of the backlight part in real time, the LED driving circuit controls the value of the current flowing into the backlight part to be positively correlated with the duty ratio of the PWM signal. The larger the duty ratio of the PWM signal is, the larger the backlight current inputted to the backlight part will be. As the duty ratio of the PWM signal is zero, the backlight current stops flowing into the backlight part so that the liquid crystal display device shows the dark state image.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

Above are embodiments of the present invention, which does not limit the scope of the present invention. Any modifications, equivalent replacements or improvements within the spirit and principles of the embodiment described above should be covered by the protected scope of the invention.

What is claimed is:

1. A liquid crystal display device, comprising a backlight part, wherein the liquid crystal display device comprises an image collection circuit, a gray scale judgment circuit, a Pulse Width Modulation (PWM) signal generation circuit and a LED driving circuit, which are electrically coupled in order, and the backlight part is electrically coupled to the LED driving circuit; the image collection circuit obtains a gray scale of a target image and transmits the gray scale of the target image to the gray scale judgment circuit, and the gray scale judgment circuit compares the gray scale of the target image with a preset gray scale threshold to generate a control signal, and transmits the control signal to the PWM signal generation circuit; the PWM signal generation circuit responds with the control signal to generate a PWM signal of which a duty ratio is zero, and transmits the PWM signal to the LED driving circuit, and the LED driving circuit responds with the PWM signal to cut off an input current of the backlight part; and wherein as the gray scale judgment circuit judges that the gray scale of the target image is smaller than the preset gray scale threshold, the gray scale judgment circuit outputs the control signal to the PWM signal generation circuit, and the PWM signal generation circuit adjusts the duty ratio of the PWM signal to be zero after receiving the control signal, and the LED driving circuit cuts off the input current of the backlight part according to the PWM signal; as the gray scale judgment circuit judges that the gray scale of the target image is larger than or equal to the preset gray scale threshold, the backlight part is inputted with a backlight current and is in an activation state.

2. The liquid crystal display device according to claim 1, wherein the preset gray scale threshold is 10.

3. The liquid crystal display device according to claim 1, wherein the PWM signal generation circuit adjusts the duty ratio of the PWM signal in real time according to the input current of the backlight part currently transmitted by the LED driving circuit as the PWM signal is generated.

4. The liquid crystal display device according to claim 1, wherein the PWM signal generation circuit comprises a square wave generator.

5. The liquid crystal display device according to claim 2, wherein the PWM signal generation circuit comprises a square wave generator.

6. An electronic apparatus, comprising a liquid crystal display device, and the liquid crystal display device comprises a backlight part, wherein the liquid crystal display device comprises an image collection circuit, a gray scale judgment circuit, a Pulse Width Modulation (PWM) signal generation circuit and a LED driving circuit, which are electrically coupled in order, and the backlight part is electrically coupled to the LED driving circuit; the image collection circuit obtains a gray scale of a target image and transmits the gray scale of the target image to the gray scale judgment circuit, and the gray scale judgment circuit compares the gray scale of the target image with a preset gray scale threshold to generate a control signal, and transmits the control signal to the PWM signal generation circuit; the PWM signal generation circuit responds with the control signal to generate a PWM signal of which a duty ratio is zero, and transmits the PWM signal to the LED driving circuit, and the LED driving circuit responds with the PWM signal to cut off an input current of the backlight part;

wherein as the gray scale judgment circuit judges that the gray scale of the target image is smaller than the preset gray scale threshold, the gray scale judgment circuit outputs the control signal to the PWM signal generation circuit, and the PWM signal generation circuit adjusts the duty ratio of the PWM signal to be zero after receiving the control signal, and the LED driving circuit cuts off the input current of the backlight part according to the PWM signal; as the gray scale judgment circuit judges that the gray scale of the target image is larger than or equal to the preset gray scale threshold, the backlight part is inputted with a backlight current and is in an activation state; and wherein the PWM signal generation circuit comprises a square wave generator.

7. The electronic apparatus according to claim 6, wherein the preset gray scale threshold is 10.

8. The electronic apparatus according to claim 6, wherein the PWM signal generation circuit adjusts the duty ratio of the PWM signal in real time according to the input current of the backlight part currently transmitted by the LED driving circuit as the PWM signal is generated.

9. A backlight adjustment method, wherein the backlight adjustment method comprises:

obtaining a gray scale of a target image with an image collection circuit and transmitting the gray scale of the target image to a gray scale judgment circuit;

comparing the gray scale of the target image with a preset gray scale threshold with a gray scale judgment circuit;

outputting a corresponding control signal to a Pulse Width Modulation (PWM) signal generation circuit with a gray scale judgment circuit as the gray scale of the target image is smaller than a preset gray scale threshold, and the PWM signal generation circuit generates a PWM signal of which a duty ratio is zero, and outputs the PWM signal to a LED driving circuit;

cutting off an input current of a backlight part with the LED driving circuit according to the PWM signal of which the duty ratio is zero;

wherein the preset gray scale threshold is 10; and wherein as the gray scale judgment circuit judges that the gray scale of the target image is larger than or equal to the preset gray scale threshold, the PWM signal generation circuit adjusts the duty ratio of the PWM signal in real time according to the input current of the backlight part currently transmitted by the LED driving circuit as the PWM signal is generated, and the LED driving circuit adjusts the input current outputted to the backlight part in real time according to the PWM signal.

10. The backlight adjustment method according to claim 9, wherein as the gray scale judgment circuit judges that the gray scale of the target image is larger than or equal to the preset gray scale threshold, the PWM signal generation circuit adjusts the duty ratio of the PWM signal in real time according to the input current of the backlight part currently transmitted by the LED driving circuit as the PWM signal is generated, and the LED driving circuit adjusts the input current outputted to the backlight part in real time according to the PWM signal.

11. The backlight adjustment method according to claim 10, wherein as the duty ratio of the PWM signal is not zero, the input current transmitted to the backlight part is positively correlated with the duty ratio of the PWM signal, and as the duty ratio of the PWM signal is zero, the input current of the backlight part is not transmitted to the backlight part.

12. The backlight adjustment method according to claim 9, wherein as the duty ratio of the PWM signal is not zero, the input current transmitted to the backlight part is positively correlated with the duty ratio of the PWM signal, and as the duty ratio of the PWM signal is zero, the input current of the backlight part is not transmitted to the backlight part.

* * * * *